United States Patent [19]

Diggle, Jr.

[11] 4,184,846

[45] Jan. 22, 1980

[54] METHOD AND APPARATUS FOR LIQUID PROCESSING OF TUBULAR KNITTED FABRICS

[75] Inventor: Edmund A. Diggle, Jr., Oradell, N.J.

[73] Assignee: Samcoe Holding Corporation, Woodside, N.Y.

[21] Appl. No.: 963,226

[22] Filed: Nov. 24, 1978

[51] Int. Cl.[2] ..... D06B 1/02; D06B 1/14

[52] U.S. Cl. ..... 8/149.1; 8/151; 26/81; 26/84; 68/5 D; 68/13 R; 68/22 R; 68/202; 68/205 R

[58] Field of Search ..... 8/149.1, 151; 68/5 D, 68/5 E, 13 R, 22 R, 22 B, 43, 202, 205 R; 26/81, 84; 118/44

[56] References Cited

U.S. PATENT DOCUMENTS

| | | | |
|---|---|---|---|
| 1,893,197 | 1/1933 | Cohn | 8/151 |
| 1,979,818 | 11/1934 | Baker | 8/151 X |
| 2,045,755 | 6/1936 | Cohn | 8/151 |
| 4,112,532 | 9/1978 | Catallo | 8/151 |

*Primary Examiner*—Philip R. Coe

*Attorney, Agent, or Firm*—Mandeville and Schweitzer

[57] ABSTRACT

The disclosure is directed to method and apparatus for processing of tubular knitted fabric with a liquid material, for uniformly impregnating the fabric with the liquid. The fabric initially is directed over a propeller-spreader frame, in which the fabric is laterally distended to flat form and to predetermined, uniform width. At the discharge end of the spreader, the fabric is guided directly into the nip of a pair of opposed, resilient pad rollers. Immediately in advance of the pad rollers, both the upper and lower surfaces of the generally horizontally disposed fabric are sprayed with the liquid processing solution. The sprays are directed from a plurality of nozzles, spaced across the width of the fabric, and directed at an angle to the surface of the fabric and toward the nip area of the pad rolls. The spreader frame is inclined downwardly toward the pad rolls, at a slight angle (e.g. 6° or 7°) such that the inevitable sagging of the wet fabric, in the area slightly in advance of the roller nip, is compensated for by the slight incline of the spreader, preventing puddling of the processing solution on the upper surface of the fabric.

10 Claims, 2 Drawing Figures

METHOD AND APPARATUS FOR LIQUID PROCESSING OF TUBULAR KNITTED FABRICS

BACKGROUND AND SUMMARY OF THE INVENTION

In the processing of tubular knitted fabric, it is not uncommon for the fabric to be processed with liquid chemical solutions of various kinds. Typical such solutions include finishing resins. Early forms of processing lines for this purpose are reflected in, for example, the S. Cohn U.S. Pat. No. 1,893,197 and U.S. Pat. No. 2,045,755, and also in the Baker U.S. Pat. No. 1,979,818, all assigned to Samcoe Holding Corporation.

In the system of the S. Cohn U.S. Pat. No. 2,045,755, for example, tubular knitted fabric is initially passed over a spreader frame, and is then guided through a pan of treating solution. After leaving the treating solution, the fabric advances into and through a pair of pad rollers, arranged to disperse the liquid through the fabric and to express from the fabric excess solution. In the arrangement of the prior patent, the approaching fabric is carried upwardly by the lower one of a pair of pad rolls, so that excess solution, extracted from the fabric in the nip, flows downwardly over the surface of the fabric. In addition, processing solution is flowed downwardly over the upper roll and is carried thereby into the roller nip.

In accordance with one of the specific aspects of the present invention, tubular knitted fabric is guided directly and immediately from the discharge end of the fabric spreader into the nip of a pair of padding rollers. Processing solution is applied to the fabric by a series of liquid sprays, directed at the fabric, immediately in advance of the roller nip. A significant advantage of this general approach is that the fabric travels only in extremely short distance between the time of application of the liquid processing solution and the passage of the fabric through the padding nip. It will be appreciated, in this respect, that tubular knitted fabric, when wet, loses geometric stability and, in many cases, may become difficult to control and process. In particular, the fabric is apt to undergo a significant loss in width whenever wet fabric is subjected to lengthwise tension which is more or less inevitable in the processing of a continuous length of fabric.

In accordance with a further aspect of the invention, the incoming tubular knitted fabric is passed over a generally horizontally disposed spreader, positioned in advance of the padding rolls. The spreader is, however, slightly inclined downwardly toward the padding roll nip. The arrangement is such that the laterally distended fabric approaches the padding nip generally horizontally, but inclined slightly downward. As the fabric approaches the nip, it becomes saturated with excess processing solution. The free liquid solution, in the region of the roller nip, will tend to flow along the fabric by gravity, if permitted to do so. By downwardly inclining the spreader frame, the natural downward sag of the fabric is sufficiently compensated for to prevent the gravity flow of the excess material in an upstream direction, which might otherwise form a puddle in the center of the fabric.

For a more complete understanding of the above and other features and advantages of the invention, reference should be made to the following detailed description of a preferred embodiment and to the accompanying drawing.

DESCRIPTION OF A PREFERRED EMBODIMENT

Figure 1:
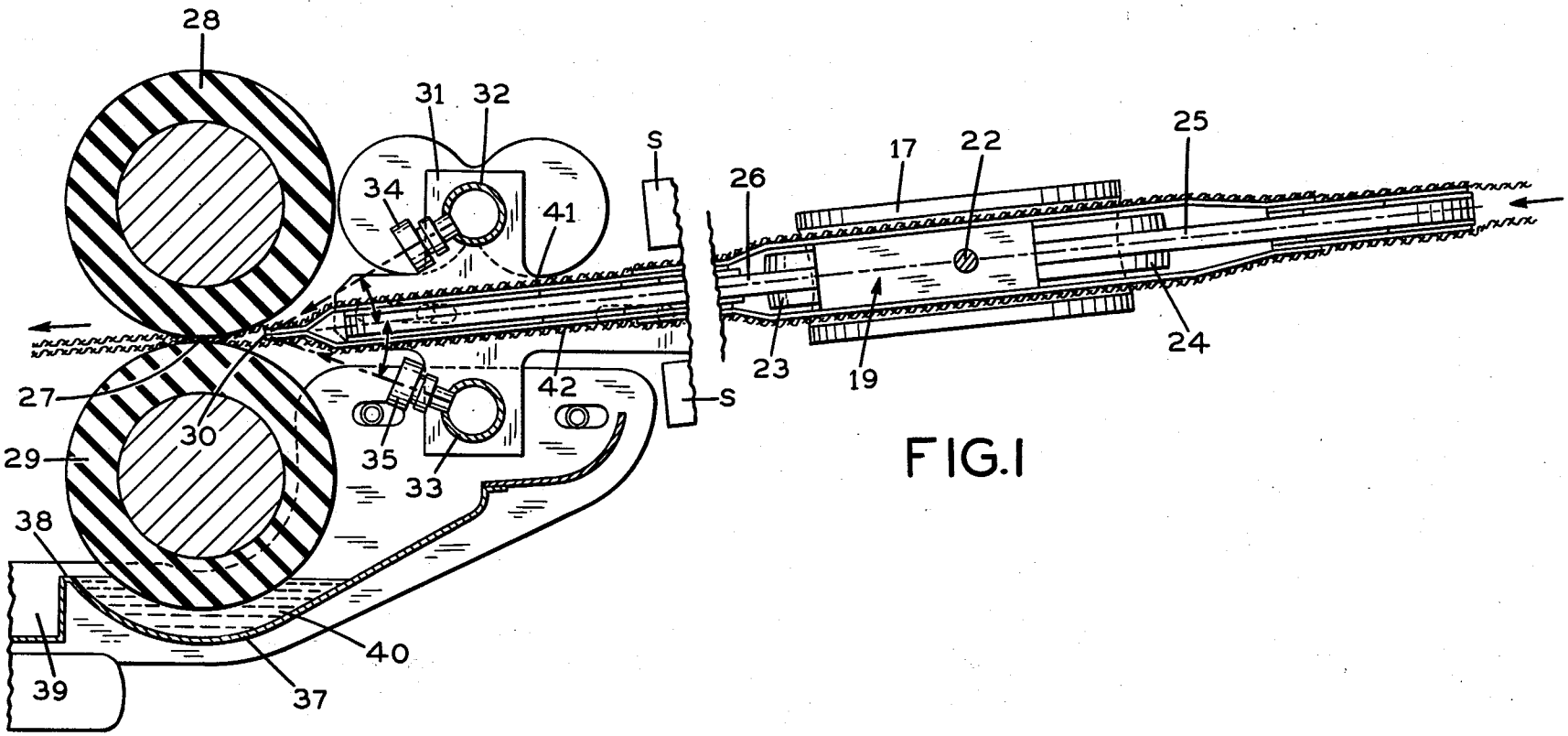
FIG. 1 is a longitudinal cross sectional view of an apparatus incorporating the principles of the invention, as taken generally on line 1—1 of FIG. 2.

Referring now to the drawing, the reference numeral 10 designates in a general way a spreading station for receiving tubular knitted fabric, distending it to flat, two-layered form and discharging it in such form at a predetermined, uniform width. The reference numeral 11 designates in a general way a liquid processing section, in which the fabric is saturated with a processing solution and then passed through a pair of opposed, resilient pad rollers, to distribute the processing solution and control the amount thereof retained in the fabric.

The spreader section may be of a known type, for example, of the type shown in the Frezza U.S. Pat. No. 4,103,402, assigned to Samcoe Holding Corporation, to which reference may be made for further details. The spreader section includes a pair of opposed edge drive carriages 12, 13, slideably mounted on transverse support rods 14, 15 and controllably movable toward and away from the center line axis of the processing equipment by means of a threaded shaft 16, which is oppositely threaded at each end so as to simultaneously shift the edge drive carriages 12, 13 toward or away from the center line of the equipment. Each of the edge drive carriages 12, 13 carries a grooved edge drive roll 17, and these rolls are controllably driven in unison by a splined shaft 18, connected to a suitable drive means (not shown) and having a slideable drive association with the respective edge drive carriages 12, 13.

A spreader frame 19 is provided which consists of opposed spreader frame sections 20, 21 connected by a telescopically adjustable center rod 22. Each of the spreader frame sections 20, 21 carries a pair of contoured drive pulleys 23, 24, which are arranged to be received in the grooved edge drive rolls 17 in a generally well known manner, to position and support the spreader frame 19. In accordance with well known principles, the spreader frame sections 20, 21 also mount a plurality of belt guide pulleys, which support upstream and downstream guide belts 25, 26 for engaging and advancing the internal edge areas of a flattened fabric tube. The upstream belts 25 diverge toward the edge drive rolls, to expand the fabric widthwise, while the downstream belts 26 typically are generally parallel, to convey the material at a uniform width. In many cases, it will be desirable to steam the fabric as it passes along the downstream section of the spreader, in which case the downstream section will be sufficiently long to accommodate the presence of steaming equipments. The steaming equipment itself may be of a well known and conventional type.

As reflected in FIG. 1, the spreader frame 19 is inclined downwardly at a small angle, and discharges the fabric essentially directly into a roller nip 27 formed by the meeting of upper and lower resiliently covered pad rollers 28, 29 respectively. Desirably, the discharge end 30 of the spreader is as close as practicable to the nip 27, with sufficient clearance being provided to prevent the spreader frame sections themselves from being gripped by the padding rolls and drawn into the nip. In any event, as indicated in FIG. 1, the discharge end 30 of the spreader is desirably on the downstream side of the plane which is tangent to the outer surfaces of the pad rollers 28, 29 on the upstream side of the nip.

Figure 2:
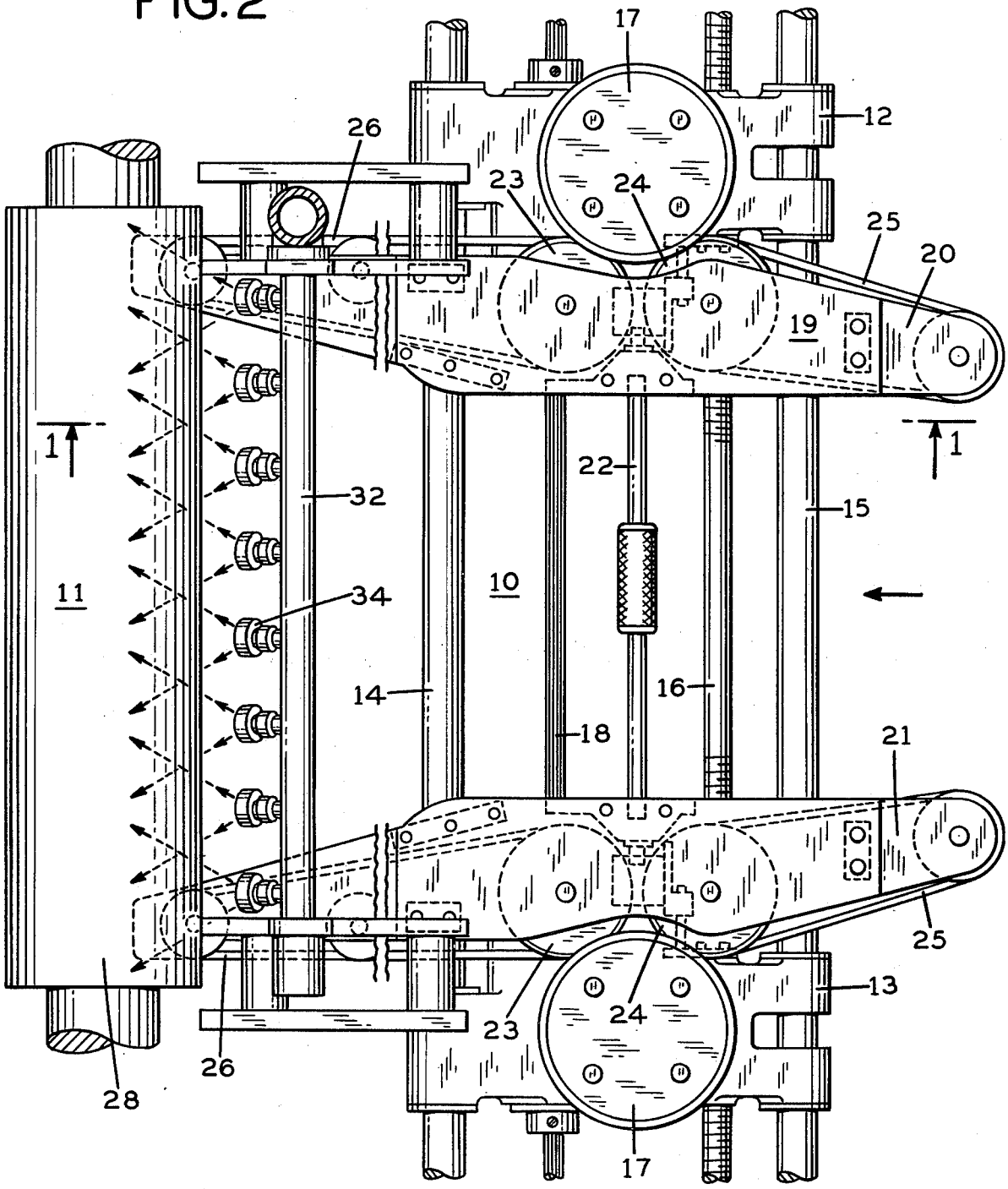
FIG. 2 is a top plan view of the apparatus of FIG. 1.

At opposite ends of the pad rollers 28, 29 there are supporting frames 31 which serve to mount transverse spray headers 32, 33 mounted respectively above and below the plane of the spreader 19. The headers 32 are connected to a source of processing solution under pressure. Each of the header pipes 32, 33 carries a spaced series of solution spray nozzles 34, 35 arranged to direct a spray of processing fluid along a nominal plane arranged to intercept with the nominal plane of the fabric in a region immediately in advance of the padding nip 27. The spray nozzles 34, 35 are arranged to eject a generally flat, fan-shaped spray. The sprays in each nozzle extending from a header pipe 32 or 33 are oriented substantially in a common plane and are arranged to somewhat overlap, as reflected in FIG. 2. By way of example and not of limitation, the spray nozzles 34, 35 may advantageously be Spraco nozzles No. 187F (0.187 inch orifice). In a representative installation, a series of such nozzles are arranged across the width of the header pipes 32, 33 with a center-to-spacing of around 6.3 mm. The sprays may be arranged to intercept at approximately 8 mm in front of the nozzles, in an area located generally 2 to 4 mm in front of the nip 27. As reflected in FIG. 1, the respective sets of nozzles 34, 35 are set on slightly different angles to the horizontal, so as to be generally symmetrical with respect to the plane of the spreader frame 19. In the illustrated arrangement, the planes in which the fan-like sprays are discharged are disposed at an angle of approximately 24° from the plane of the spreader 19, which provides for relatively optimum access of the sprayed solution into the working area in front of the processing nip 27. To advantage, the bracket 31, mounting the spray header pipes 32, 33, is adjustable slightly fore and aft to permit easy adjustment of the spray intersection with the plane of the fabric if necessary.

Mounted below the pad rollers 28, 29 is a solution pan structure 36, including a lower or shallow solution pan 37 directly underlying the lower pad roller 29. The solution pan 37 has an overflow lip 38, from which excess fluid flows into a sump area 39, and from there back to a recirculation container (not shown). As is evident from FIG. 1, the lower portion of the lower pad roller 29 dips below the level of the solution 40 in the pan 37, and a certain amount of this solution is carried by the surface of the pad roller 29 up into the nip area 27. In general, this is desired to augment the action of the lower spray nozzles 35, which tend to be somewhat less effective in saturating the fabric with solution than the upper nozzles 34, in that gravity works to assist the upper nozzles while somewhat inhibiting the effect of the lower nozzles 35.

Pursuant to the invention, the entire structure of the edge drive carriages 12, 13 and edge drive rolls 17 is raised somewhat above a horizontal plane through the roller nip 27, and is angled slightly downward, in order to incline the spreader 19 in a downward direction toward the nip 27. In practice, it has been found than an angle of incline on the order of 6° or 7° is about optimum under most circumstances. In this respect, it is desirable for a number of reasons to maintain the spreader frame 19 in a generally horizontal disposition, so that increasingly large angles of incline are increasingly disadvantageous from this viewpoint. On the other hand, too small an angle of incline will cause and/or permit accumulated processing liquid on the upper layer 41 of the tubular fabric to form a puddle in the center of the fabric, upstream of the roller nip. And as soon as such a puddle begins to form, the fabric will want to sag even further than normal, further increasing the tendency for the solution to puddle. Such an action not only results in distortions to the fabric, but also can result in undesirable non-uniformities in the processing of the fabric because of greater retention time and/or greater saturation in the center areas of the fabric, where the solution is puddled.

In the specifically illustrated form of the invention, the padding rollers 28, 29 are mounted one above the other, with their axes lying in a common vertical plane. It would be possible, of course, for the plane of the padding rollers to be inclined to be at right angles to the plane of the fabric. However, this is generally unnecessary, in view of the relatively low angle of incline of the spreader 19, and vertical orientation of the pad roller pair is more compatible with the use of existing padding equipment and thus has certain economic advantages.

In the processing of tubular knitted fabric in accordance with the invention, dry fabric (typically) is advanced over the upstream end of the spreader frame and is distended to a flat condition and of a uniform, predetermined width. After passing the area of the edge drive rolls 17, the dry fabric is subjected to steaming by the steamers S and then is advanced onward toward the roller nip 27. Immediately in advance of the roller nip, the tubular fabric is subjected to the action of the overlapping sprays on the upper and lower nozzles 34, 35, such that the fabric is thoroughly saturated with processing solution. Because of the described downward incline of the spreader frame 19, the processing solution applied to the upper layer 41 of fabric tends to be carried directly into the padding nip 27. Of course, the pressing out action of the padding rollers 28, 29 will tend to cause an accumulation of a small amount of the processing solution on the incoming side of the roller nip, but this is prevented by the slightly inclined disposition of the spreader frame 19 from flowing in an upstream direction sufficiently to form a puddle. The lower layer 42 of the fabric is likewise subjected to sprays from the nozzles 35. The spray material resulting from the lower nozzles, together with solution clinging to the surface of the rotating lower pad roller 29, serves to supply the lower fabric layer 42 with a proper amount of processing solution.

The apparatus and process of the invention, while highly simplified in nature, provide for significant processing advantages over prior systems, in which the tubular knitted fabric is guided through a bath of liquid before entering the padding nip. In the prior systems, it is usually necessary to discharge the fabric from the spreader and apply the fabric to the surface of a processing roller for conveyance through the processing solution. Unavoidably, there can be significant loss of control over the fabric geometry, and/or undesirable loss of fabric width as the wet fabric is conveyed toward the padding nip. By reducing to a practical minimum the distance between the discharge of the fabric from its spreader and passage of the solution-carrying fabric through the processing nip 27, maximum geometric control over the fabric is maintained, and uncontrolled width loss is reduced to an absolute minimum. In general, the ability to process in this manner is made possible by slightly downwardly inclining the spreader 19, in order to prevent undesirable back flow and puddling of the processing solution on the upper fabric layer 41. At the same time, the incline of the fabric spreader is kept sufficiently low that the fabric is, in essence, being processed horizontally, which is greatly to be desired.

It should be understood, of course, that the specific form of the invention herein illustrated and described is intended to be representative only, and certain changes may be made therein without departing from the clear teachings of the disclosure. Accordingly, reference should be made to the following appended claims in determining the full scope of the invention.

I claim:

1. The process of liquid treating tubular knitted fabric, which comprises (a) advancing the fabric in a generally horizontal direction while laterally distending the fabric to a predetermined uniform width, (b) in the case of dry fabric, steaming such fabric while it is thus laterally distended, (c) discontinuing said lateral distending step and guiding said fabric substantially immediately and directly, and in a generally horizontal direction, into and through the pressure nip of a pair of resilient pressure rollers, (d) introducing processing liquid into contact with the fabric in the region immediately upstream of said pressure nip, and (e) guiding said fabric in a slightly downward direction in the region immediately in advance of said pressure nip, while continuing to laterally distend said fabric, whereby excess processing fluid on said fabric, in the region immediately in advance of said pressure nip, is prevented from excessively sagging said fabric sufficiently to form a puddle of processing solution on said fabric.

2. The process of claim 1, further characterized by (a) said processing solution being applied to said fabric primarily in the form of sprays, directed upon the upper and lower surfaces of said fabric in the region immediately in advance of said roller nip.

3. The process of claim 2, further characterized by (a) overspray solution squeezed from said fabric in said pressure nip being collected and confined below the lower one of the pressure rollers, (b) at least a portion of said collected solution being maintained in contact with the surface of said lower roller during processing.

4. The process of claim 1, further characterized by (a) said fabric being engaged and supported substantially only by its opposite side edge areas during said lateral distending.

5. The process of claim 4, further characterized by (a) said fabric, during said lateral distending stage, being guided substantially in a plane, (b) said plane being inclined downwardly toward said pressure nip, at an angle of less than ten degrees.

6. The process of claim 5, further characterized by (a) said plane being inclined downwardly at an angle of approximately six-seven degrees.

7. The process of treating dry tubular knitted fabric, which comprises (a) engaging and supporting the tube of fabric by internal edge areas and laterally distending the tube to flat, two layer form and to a predetermined width, (b) advancing the thus distended fabric in a slightly downwardly inclined plane of less than ten degrees to the horizontal toward a pressure rolling station, (c) steaming the advancing distended fabric, (d) substantially simultaneously discontinuing said distending step and subjecting said fabric to resilient rolling pressure, and (e) directing sprays of processing solution onto the upper and lower surfaces of said fabric as it enters said rolling pressure stage.

8. Apparatus for liquid processing of tubular knitted fabric, which comprises (a) a pair of resilient rollers mounted one above the other and forming a resilient pressure nip, (b) a tubular fabric spreader comprising a pair of laterally spaced spreader frame sections for engaging and supporting internal lateral edges of a fabric tube while distending the fabric to flat form and to a predetermined uniform width, (c) means for supporting said spreader at a downwardly inclined angle of less than ten degrees, (d) said supporting means and said spreader being so arranged that the discharge end of said spreader is positioned substantially at said pressure nip for the direct discharge of fabric into said pressure nip, and (e) means for introducing processing solution to the fabric surface immediately in advance of said pressure nip.

9. Apparatus according to claim 8, further characterized by (a) said means for introducing processing solution comprising a series of laterally spaced spray nozzles positioned above and below the plane of the fabric and arranged to direct spray solution onto the upper and lower surfaces of the fabric immediately in advance of said pressure nip.

10. Apparatus according to claim 9, further characterized by (a) said spray nozzles being arranged in closely spaced relation and being adapted to issue generally flat, fan-like overlapping sprays, (b) said spray nozzles being disposed at a relatively low angle to the plane of the fabric spreader and being directed generally toward said pressure nip.

* * * * *